US010662699B2

(12) United States Patent
Soha

(10) Patent No.: US 10,662,699 B2
(45) Date of Patent: May 26, 2020

(54) RAIN SHIELD FOR SINGLE AND DOUBLE HUNG WINDOWS

(71) Applicant: Bobby R Soha, Brooklyn, OH (US)

(72) Inventor: Bobby R Soha, Brooklyn, OH (US)

( * ) Notice: Subject to any disclaimer, the term of this patent is extended or adjusted under 35 U.S.C. 154(b) by 2 days.

(21) Appl. No.: 16/000,040

(22) Filed: Jun. 5, 2018

(65) Prior Publication Data

US 2018/0283085 A1 Oct. 4, 2018

Related U.S. Application Data

(63) Continuation-in-part of application No. 14/641,165, filed on Mar. 6, 2015, now abandoned.

(51) Int. Cl.

| | |
|---|---|
| ***E06B 1/34*** | (2006.01) |
| ***E06B 3/30*** | (2006.01) |
| ***E06B 9/00*** | (2006.01) |
| ***E06B 3/28*** | (2006.01) |
| ***E06B 7/02*** | (2006.01) |
| ***E06B 3/44*** | (2006.01) |
| ***E06B 9/04*** | (2006.01) |
| ***E06B 9/02*** | (2006.01) |

(52) U.S. Cl.

CPC ..... *E06B 3/28* (2013.01); *E06B 3/44* (2013.01); *E06B 7/02* (2013.01); *E06B 9/02* (2013.01); *E06B 9/04* (2013.01); *E06B 1/34* (2013.01); *E06B 1/342* (2013.01); *E06B 2009/005* (2013.01)

(58) Field of Classification Search

CPC ... E06B 1/34; E06B 1/342; E06B 3/30; E06B 7/26; E06B 9/00; E06B 3/325; E06B 1/6084

See application file for complete search history.

(56) References Cited

U.S. PATENT DOCUMENTS

| | | | | | |
|---|---|---|---|---|---|
| 752,348 | A * | 2/1904 | Lutts | E06B 7/26 160/59 |
| 1,075,058 | A * | 10/1913 | Orth | E06B 7/26 454/220 |
| 1,432,112 | A * | 10/1922 | Lewis | E06B 7/26 454/220 |
| 1,465,722 | A * | 8/1923 | Thomas | E06B 7/26 454/220 |
| 1,586,089 | A * | 5/1926 | Krewson | E06B 7/26 454/220 |
| 1,719,980 | A * | 7/1929 | Imbruglia | E06B 7/26 454/220 |

(Continued)

FOREIGN PATENT DOCUMENTS

| | | | | |
|---|---|---|---|---|
| GB | 2369645 | A * | 6/2002 | E06B 9/00 |
| WO | WO-2011009930 | A2 * | 1/2011 | E06B 7/02 |

*Primary Examiner* — Phi D A

(74) *Attorney, Agent, or Firm* — Dominic A. Frisina

(57) ABSTRACT

A rain shield is provided for exterior architectural windows which prevents rain water from intruding into a dwelling. The rain shield may include a generally rectangular-planar shield member. The device may also include first and second lower fixed pivots disposed on a lower portion of opposing sides of the shield member. The first and second fixed pivots may be oppositely directed from each other and cooperate to pivot the device between stowed and deployed configurations. The rain shield may also include first and second lateral supports disposed on either side of the shield member.

3 Claims, 12 Drawing Sheets

(56) References Cited

U.S. PATENT DOCUMENTS 1,967,974 A * 7/1934 Schaefer ..... E06B 7/26 454/220
2,016,784 A * 10/1935 Kraenzlein ..... C07B 45/02 562/828
2,109,545 A * 3/1938 McGrane ..... E06B 7/26 160/352
2,221,005 A 11/1940 Reese
2,503,849 A * 4/1950 Smith ..... E06B 7/26 160/369
2,612,947 A 10/1952 Jenks
2,805,711 A * 9/1957 Mehl ..... E04F 10/02 160/74
2,808,774 A * 10/1957 Camerino ..... E06B 7/26 454/213
3,099,950 A * 8/1963 Christian ..... E06B 7/26 454/215
3,116,519 A * 1/1964 Sumner ..... E06B 7/26 454/226
3,124,055 A * 3/1964 Rubera ..... E06B 7/26 454/220
3,743,346 A * 7/1973 Senn ..... B60P 3/34 296/164
3,792,557 A * 2/1974 Pitts ..... E04B 1/3444 52/127.1
4,184,295 A * 1/1980 Hicks ..... E04F 10/00 160/59
4,405,008 A * 9/1983 Hazlett ..... E06B 9/0669 160/213
5,228,238 A 7/1993 Fenkell
5,487,244 A 1/1996 Hill
5,768,833 A 6/1998 Golen
6,269,597 B1 8/2001 Haas
6,712,422 B1 * 3/2004 Vaillancourt ..... B60P 3/341 296/164
6,761,000 B1 * 7/2004 Heijting ..... G09F 15/0056 160/135
7,165,596 B1 * 1/2007 Helton ..... E06B 7/26 160/222
7,584,579 B1 9/2009 Everitt
7,730,932 B1 * 6/2010 Bauer ..... E06B 9/00 160/31
7,805,897 B2 10/2010 Holland et al.
8,966,839 B2 3/2015 Rebman et al.
9,079,380 B2 * 7/2015 Monteer ..... B32B 21/02
9,334,685 B1 * 5/2016 DeMoore ..... E06B 7/26
9,353,529 B2 * 5/2016 Richmeier ..... E04F 10/02
2004/0040230 A1 * 3/2004 Taegar ..... E06B 9/04 52/202
2006/0090407 A1 * 5/2006 Hoffmann ..... B65G 69/008 52/173.2
2006/0179735 A1 * 8/2006 McNelis ..... E06B 9/02 52/202
2008/0034671 A1 * 2/2008 Harrington ..... E06B 9/00 52/2.26
2009/0038244 A1 2/2009 Kuhn et al.
2009/0266013 A1 10/2009 Motosko et al.
2009/0313920 A1 12/2009 Jaure
2013/0186008 A1 7/2013 Gower
2013/0239497 A1 9/2013 Burleson
2014/0041324 A1 2/2014 Massey
2014/0144090 A1 5/2014 Rebman et al.
2016/0258208 A1 9/2016 Soha

* cited by examiner

RAIN SHIELD FOR SINGLE AND DOUBLE HUNG WINDOWS

I. BACKGROUND OF THE INVENTION

A. Field of Invention

Embodiments may generally relate to the field of rain shields for residential windows.

B. Description of the Related Art

A long-standing problem with exterior single and double hung architectural windows is that they permit water intrusion if they are kept open during a rain storm. Window screen is common, but ineffective. Screen partially excludes rain droplets but permits a significant amount of spray to pass through the screen. Another common solution is an exterior awning mounting to the dwelling. While effective, they are not aesthetically pleasing to many homeowners. To those who do not appreciate the look of a traditional awning, there remains no other solution that to either close the window or accept water intrusion as a necessary side-effect. Thus, there remains a gap in the art where homeowners have no device that they can use from inside the home to exclude rain water while keeping their windows open during a rain storm.

Some embodiments of the present invention may provide one or more benefits or advantages over the prior art.

II. SUMMARY OF THE INVENTION

Some embodiments may relate to a rain shield for an exterior architectural window, comprising: a shield member defining a generally rectangular-planar surface. The shield member may include a top edge, a bottom edge, a first side edge, and a second side edge. A first side panel member of the device may define a generally triangular-planar surface. The first side panel member may include an outward face and an inward face, and having three side edges, namely, a top side edge, a hinge side edge, and a clasp side edge. The hinge side edge may be hingedly joined to the first side edge of the shield member. The device may further include a first clasp member disposed at the clasp side edge of the first side panel member, and may comprise a portion of the first side panel member turned outwardly at about 90 degrees relative to the outward face of the first side panel member. Embodiments may further include a second side panel member defining a generally triangular-planar surface. The second side panel member may include an outward face and an inward face, and may have three side edges, namely, a top side edge, a hinge side edge, and a clasp side edge. The hinge side edge is hingedly joined to the first side edge of the shield member. The device may further include a second clasp member disposed at the clasp side edge of the second side panel member. The clasp may comprise a portion of the second side panel member turned outwardly at about 90 degrees relative to the outward face of the second side panel member.

According to some embodiments a shield member defines a width between the first and second side edges approximately equal to the width of a co-operable architectural window opening.

According to some embodiments a the shield member comprises: an inner shield panel defining a generally rectangular-planar surface having a top edge, a bottom edge, a first side edge, and a second side edge; and an outer shield panel defining a generally rectangular-planar surface having a top edge, a bottom edge, a first side edge, and a second side edge, wherein the outer shield panel further comprises a top channel disposed at the top edge of the outer shield panel, and a bottom channel disposed at the bottom edge of the outer shield panel, and wherein the top channel slideably receives the top edge of the inner shield panel, and the bottom channel slideably receives the bottom edge of the inner shield panel.

According to some embodiments a the first side panel member is hingedly joined to the first side edge of the outer shield panel, and the second side panel member is hingedly joined to the second side edge of the inner shield panel.

According to some embodiments a the hinge side edges of the first and second side panel members are hingedly joined to the shield member through first and second flex hinge panels.

Embodiments may also comprise a bottom channel defined by a flap of the outer shield panel extending from the bottom edge of the outer shield panel parallel to and spaced apart from the outer shield panel.

Embodiments may also comprise a top channel defined by a flap of the outer shield panel extending from the top edge of the outer shield panel parallel to and spaced apart from the outer shield panel.

Embodiment may relate to a rain shield for an exterior architectural window. Such a device may include a shield member defining a generally rectangular-planar surface having a top edge, a bottom edge, a first side edge, and a second side edge. The device may also have a first lower fixed pivot disposed on a lower portion of the first side of the shield member. It may further include a second lower fixed pivot disposed on a lower portion of the second side of the shield member. Moreover, the first and second fixed pivots are oppositely directed from each other. The rain shield may also include a first retractable upper lateral support disposed on an upper portion of the first side of the shield member; and a second retractable upper lateral support disposed on an upper portion of the second side of the shield member.

According to some embodiments the shield member comprises an upper shield member and a lower shield member subtending an interior angle $\phi$ between 100° and 170°.

According to some embodiments the first upper lateral support comprises a first folding brace having a first slide pin outward-laterally disposed on an outward-facing surface of the first folding brace.

According to some embodiments the second upper lateral support comprises a second folding brace having a second slide pin outward-laterally disposed on an outward-facing surface of the second folding brace, wherein the first and second slide pins are co-operable with laterally disposed vertical tracks of a window frame to support the rain shield in tension with the vertical tracks.

According to some embodiments the first lower fixed pivot, the second lower fixed pivot, the first upper lateral support, and/or the second upper lateral support are adapted to retain the rain shield in a stowed and/or deployed configuration.

According to some embodiments the first and/or second lower fixed pivots comprise either a pivot pin or a recess operable to receive a pivot pin, the pivot pin and recess being co-operably matable as a journal bearing.

Embodiments may further comprise a window frame. According to such embodiments the first upper lateral support may comprise a first folding brace having a first slide pin outward-laterally disposed on an outward-facing surface of the first folding brace. A second upper lateral support may comprise a second folding brace having a second slide pin outward-laterally disposed on an outward-facing surface of the second folding brace. A first laterally disposed vertical track of the window frame may be co-operable with the first slide pin to support the rain shield in tension. The first slide pin may be slidably received by the first vertical track. A second laterally disposed vertical track of the window frame may be co-operable with the second slide pin to support the rain shield in tension. The second slide pin may be slidably received by the second vertical track. The window frame may be dimensioned to receive the shield member, the first and second lower fixed pivots, and the first and second upper lateral supports in a fully stowed configuration without interfering with the window frame or with an upper or lower window pane.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof, wherein like reference numerals indicate like structure, and wherein.

IV. DETAILED DESCRIPTION OF THE INVENTION

As used herein the terms "embodiment", "embodiments", "some embodiments", "other embodiments" and so on are not exclusive of one another. Except where there is an explicit statement to the contrary, all descriptions of the features and elements of the various embodiments disclosed herein may be combined in all operable combinations thereof.

Language used herein to describe process steps may include words such as "then" which suggest an order of operations; however, one skilled in the art will appreciate that the use of such terms is often a matter of convenience and does not necessarily limit the process being described to a particular order of steps.

Conjunctions and combinations of conjunctions (e.g. "and/or") are used herein when reciting elements and characteristics of embodiments; however, unless specifically stated to the contrary or required by context, "and", "or" and "and/or" are interchangeable and do not necessarily require every element of a list or only one element of a list to the exclusion of others.

Terms of degree such as "about" or "approximately" are used herein to describe non-exact quantities. Read in context, the person having ordinary skill in the art would understand how to make and use the invention within the constraints of these terms, and without undue experimentation.

Figure 1:
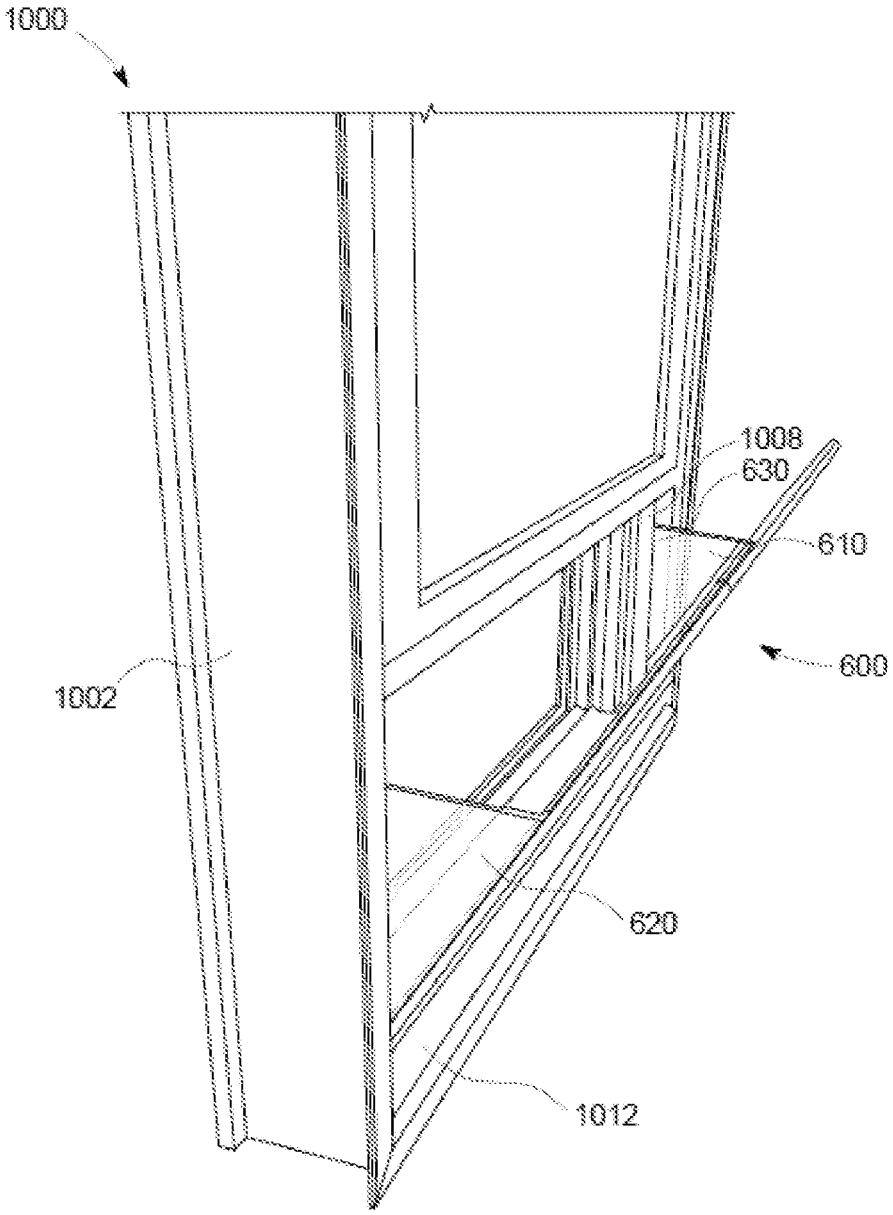
FIG. 1 is a side perspective view of an embodiment installed in a prefabricated double hung window.

Referring now to the drawings wherein the showings are for purposes of illustrating embodiments of the invention only and not for purposes of limiting the same, FIG. 1 is a perspective view of a two-panel expandable-width embodiment installed in a prefabricated architectural window 1000. The device is shown installed inside a widow frame 1002 resting against a bottom lip 1012 of the window 1000. The embodiment includes a shield member 600, a first side panel 610 and a second side panel 620. Further, the embodiment is shown anchored to a track 1008 of the window ordinarily used to slide the window pane up and down. The embodiment engages the track 1008 with a clasp member 630. The shield member 600 is angled away from the window frame 1002 by the triangular side members 610, 620 which are both clasped to the window track 1008. This creates a space where outside air can flow into the dwelling while the shield member 600 catches any rain water and returns it to the window frame 1002 where it can flow to the outside.

Figure 2:
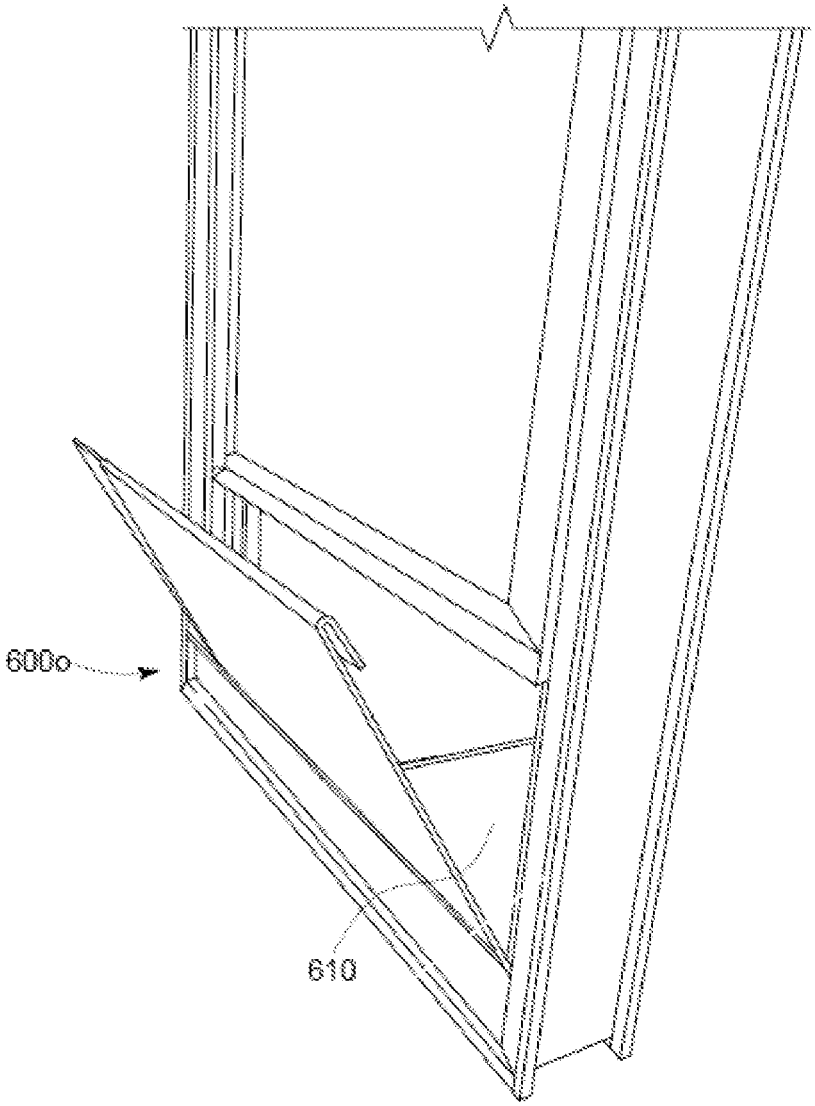
FIG. 2 is an opposing side perspective view of the embodiment of FIG. 1.
Figure 3:
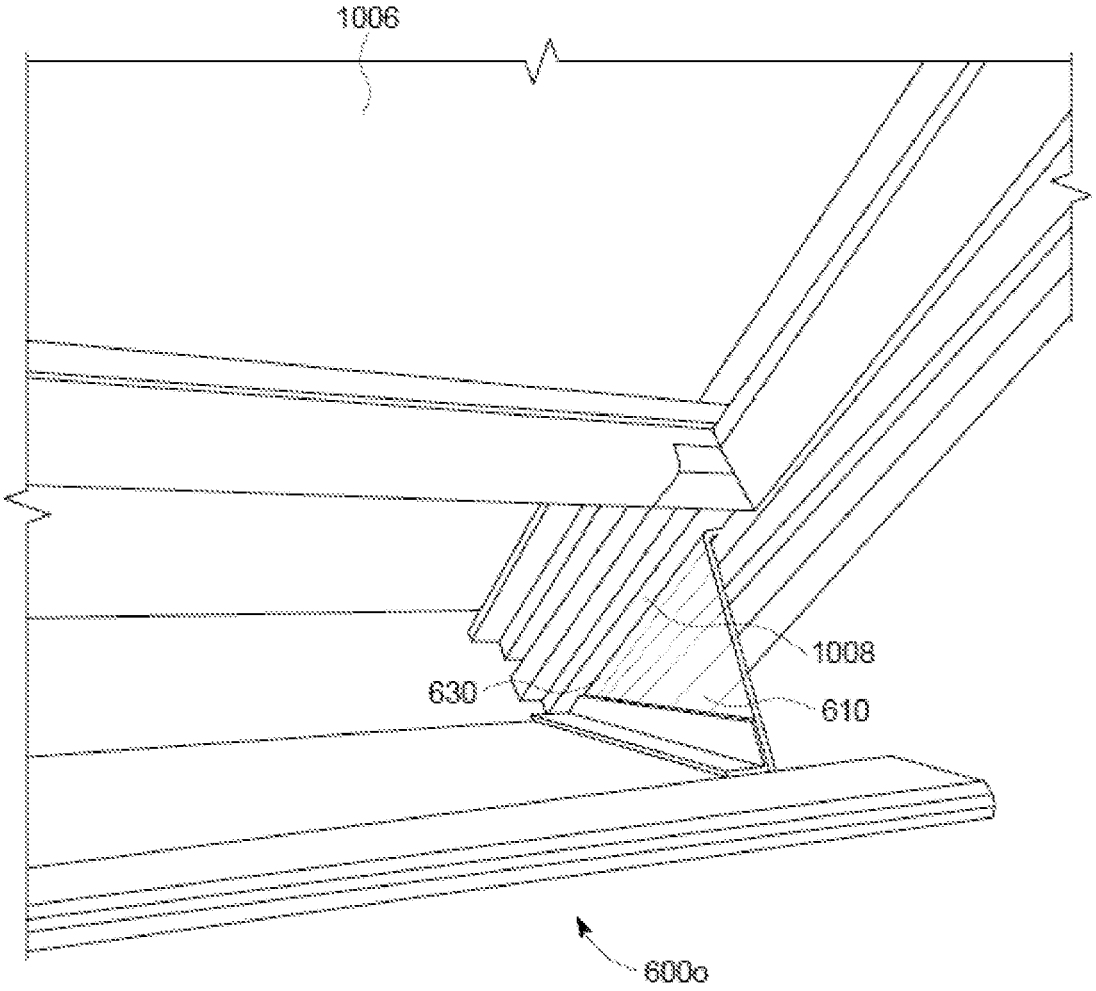
FIG. 3 is a top perspective view of the embodiment of FIG. 1 showing a clasp cooperating with a window track.

FIG. 2 shows the same embodiment of FIG. 1 from the opposing side where the outer shield panel 600*o* is clearly visible. Comparing FIG. 1 and FIG. 2 makes it clear that the first and second side members 610, 620 of this embodiment are mirror images of each other. FIG. 3 is a top perspective view showing the clasp 630 of the first side panel 610 cooperating with the window track 1008.

Figure 4:
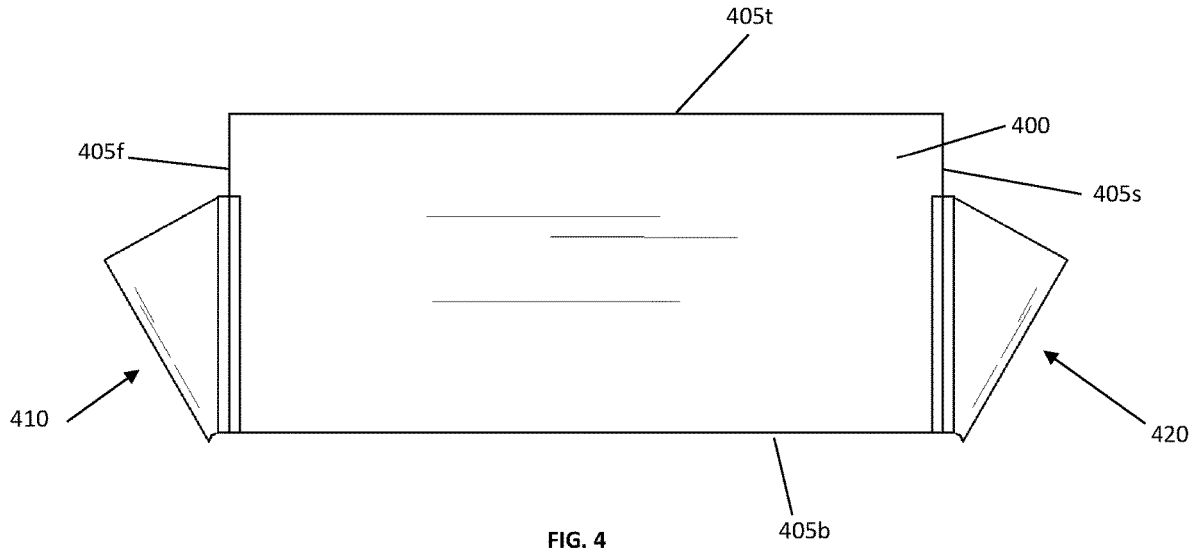
FIG. 4 is a plan view from the exterior side of an embodiment.

FIG. 4 is a plan view of a single-panel embodiment. The embodiment is viewed from the window-facing side. It includes a shield panel 400 having a top edge 405*t*, a bottom edge 405*b*, a first side edge 405*f*, and a second side edge 405*s* collectively defining a generally rectangular-planar shaped surface. The embodiment also includes a first side panel member 410, and a second side panel member 420 both of which include clasps as will be describe in more detail.

Figure 5:
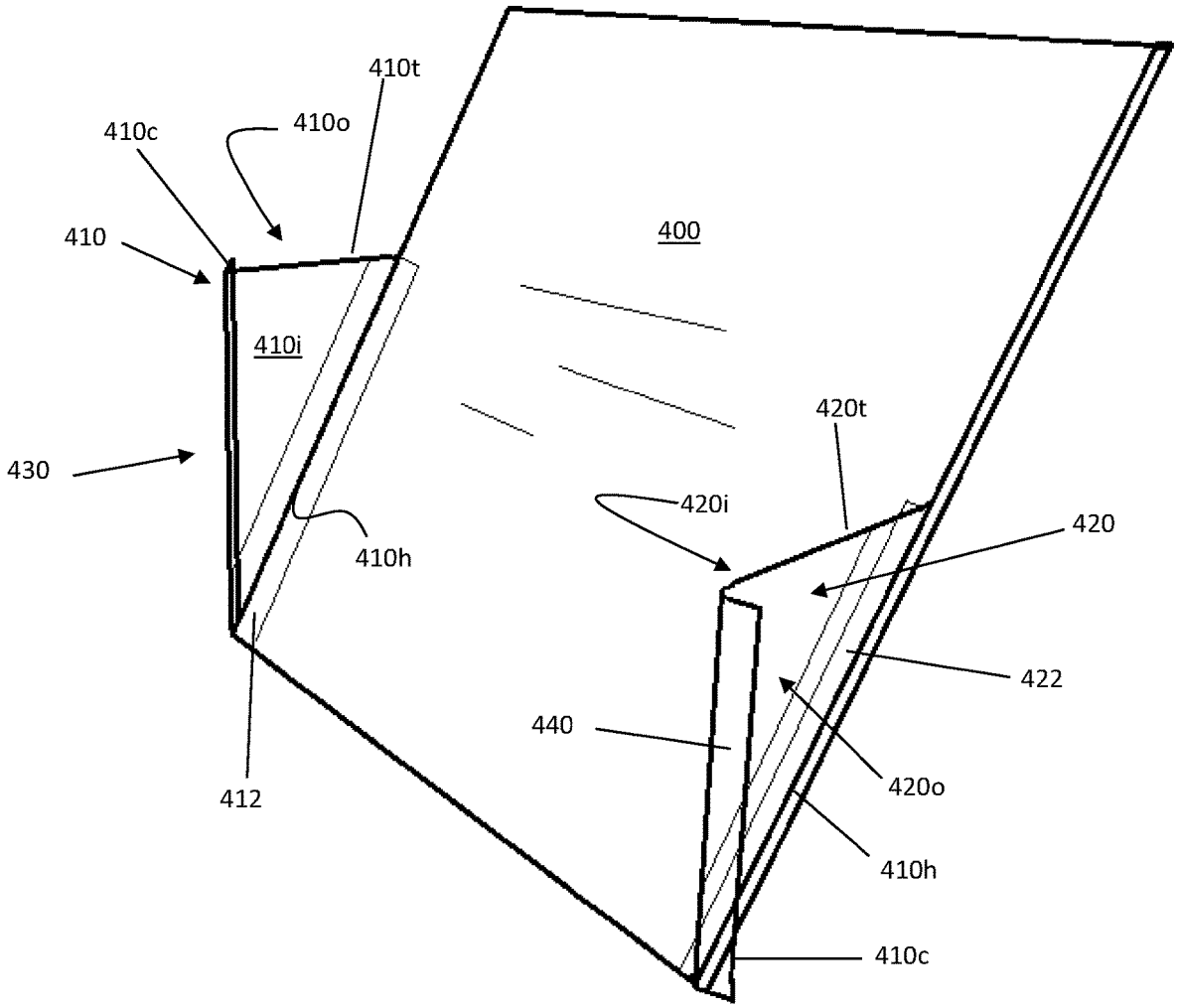
FIG. 5 is a perspective view of the embodiment of FIG. 4 from the exterior side.

FIG. 5 is a perspective view of the FIG. 4 embodiment viewed from the window-facing side. This view better illustrates the motion of the side panel members about their hinges 412, 422. More specifically, the first side panel member 410 includes a top edge 410*t*, a hinge edge 410*h*, and a clasp edge 410*c*, defining a generally triangular sheet. Being a generally triangular sheet, the first side panel member further includes an inward face 410*i*, and an outward face 410*o*. The first side panel member 410 further includes a first clasp member 430. The first clasp member 430 of the illustrated embodiment is simply an extension of the sheet material forming the first side panel member 410 folded outward at about 90 degrees relative to outward face 410*o*. Accordingly, the clasp edge 410*c* of the first side panel member is the terminal edge of the portion of the sheet forming the clasp 430.

As used here, the terms inward and outward are used relative to the embodiment, and not with reference to the interior or exterior of a dwelling. More specifically, "inward" and "outward" refer to the partially enclosed space formed by the embodiment when installed in a window. Thus, an "inward" surface faces toward the partially enclosed space, while an "outward" surface faces away from the partially enclosed space.

With further regard to FIG. 5, the first side panel member 410 is hingedly joined to the to the first side edge 405*f* of the shield member, i.e. panel 400. In the present embodiment the parts are hingedly joined through a flexible polymer hinge panel 412 bonded to both parts along the hinge side edge 410*h* and the first side edge 405*f* respectively. The hinge panels 412 and 422 each comprise a strip of flexible polymeric sheet material, which may be bonded, welded, or otherwise joined to the side panel member and side edge of the shield panel.

The skilled artisan will readily appreciate that the invention is not limited to flexible hinge panels, and in fact includes any suitable structure capable of achieving the desired range of motion. For instance, embodiments may utilize a living hinge whereby the side panel members are integrally formed with the shield panel as a single continuous part rather than joined parts. Alternatively, embodiments may be molded as a sufficiently thin and flexible sheet so that no hinge is necessary. For instance, a molded embodiment may have the side panel members fixed in a configuration ready to clasp a window track. In such embodiments, the thin sheet may be sufficiently flexible to be elastically bent by hand thus permitting easy installation in a window track.

Continuing with respect to FIG. 5, the second side panel member 420 is a mirror image of the first 410. Like the first side panel member 410, the second 420 includes a top edge 420*t*, a hinge edge 420*h*, and a clasp edge 420*c*, an inward face 420*i*, and an outward face 420*o*. Similarly, the second side panel member 420 includes a second clasp member 440 formed from an extension of the side member's 420 sheet material bent at about 90 degrees relative to the outward face 420*o*. Moreover, the second side panel member 420 is hingedly joined at its hinge edge 420*h* to the second side edge 405*s* of the shield panel 400, by a second flex hinge panel 422 bonded thereto.

Figure 6:
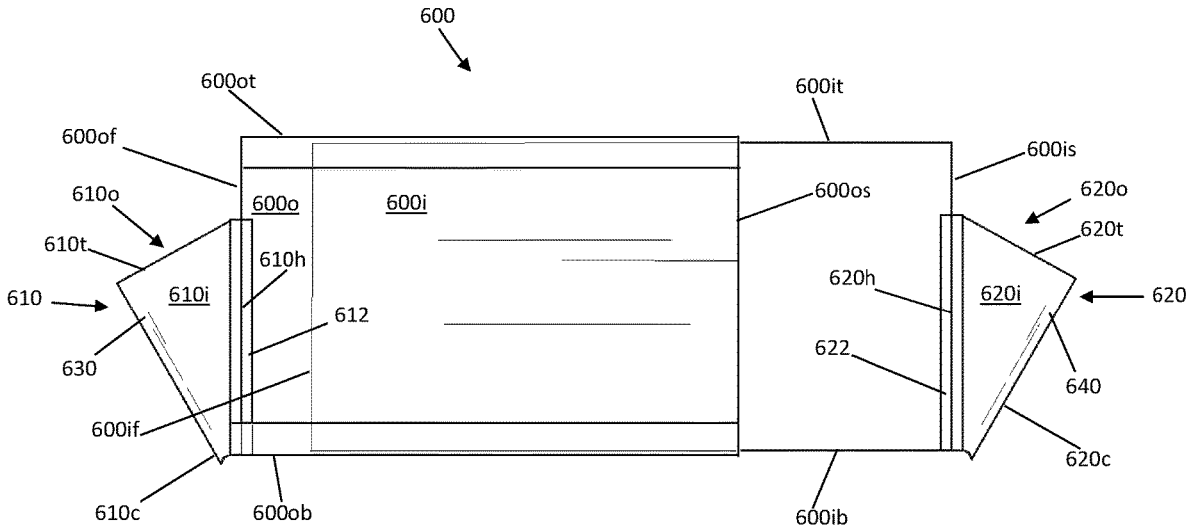
FIG. 6 is a plan view from the exterior side of an embodiment.

FIG. 6 is a plan view illustration of a width-adjustable embodiment viewed from the window-facing side of the embodiment. In contrast to the embodiment of FIGS. 4 and 5, the width-adjustable embodiment includes a shield member 600 comprising two parts, namely, an inner shield panel 600*i*, and an outer shield panel 600*o* which are adapted, as will be described shortly, to slidably cooperate with each other to fit windows having a range of widths. The inner shield panel 600*i* includes a top edge 600*it*, a bottom edge 600*ib*, a first side edge 600*if*, and a second side edge 600*is*, which collective define a generally rectangular sheet. Similarly, the outer shield panel 600*o* includes a top edge 600*ot*, a bottom edge 600*ob*, a first edge 600*of*, and a second edge 600*os*, which collectively define a generally rectangular sheet. The outer shield panel 600*o* includes channels or tracks that slidably receive the inner shield panel 600*i*, thus creating the width-adjusting feature of the embodiment. As will described in more detail, these tracks or channels may be formed, for example and without limitation, by folding over the sheet material defining the outer shield panel 600*o*.

Similar to the embodiment illustrated in FIGS. 4 and 5, the width-adjustable embodiment includes a pair of mirror image side panel members, denominated first side panel member 610 and second side panel member 620. The side panel members respectively include a top side edge 610*t*, 620*t*; a hinge side edge 610*h*, 620*h*; and a clasp slide edge 610*c*, 620*c* collectively defining generally triangular sheets. Both side members 610, 620 also include inward faces 610*i*, 620*i*; and outward faces 610*o*, 620*o*. Further, the first side member 610 includes a first clasp member 630 while the second clasp member 620 includes a second clasp member 640. The first side panel member 610 is hingedly joined along its first hinge side edge 610*h* to the shield member 600 along the first side edge of the outer shield panel 600*of* through a first flex hinge panel 612. Similarly, the second side panel member 620 is hingedly joined along its second hinge side edge 620*h* to the shield member 600 along the second side edge of the inner shield panel 600*is* through a second flex hinge panel 612.

Figure 7:
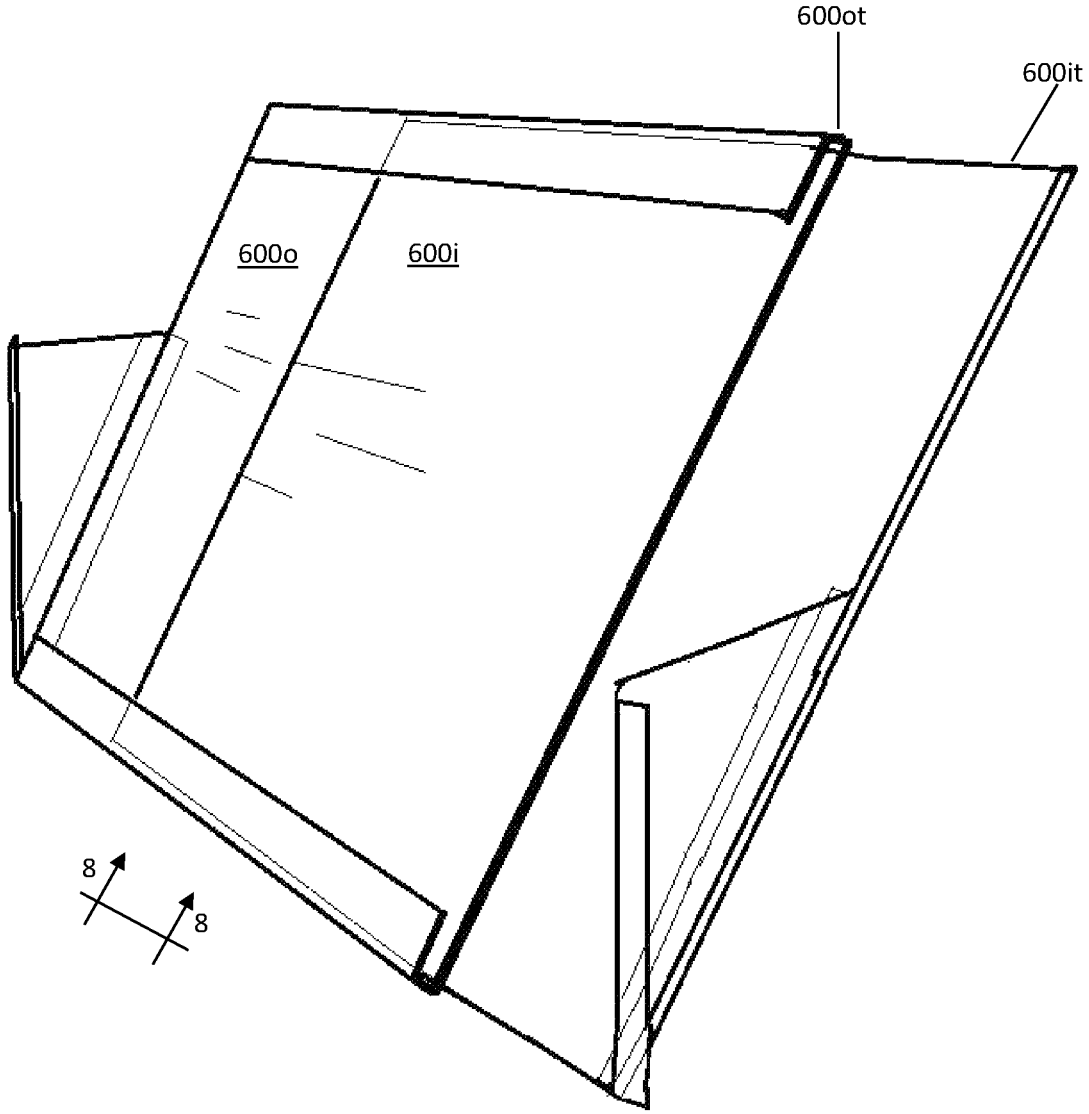
FIG. 7 is a perspective view of the embodiment of FIG. 6 from the exterior side.

Turning to FIG. 7, the embodiment of FIG. 6 is shown in a window-facing perspective view more clearly illustrating the channel of the outer shield panel 600*o*. The inner shield panel 600*i* is shown being slidably received by the outer shield panel 600*o* in top and bottom channels. The top and bottom channels of the illustrated embodiment are defined by a continuous extension of the sheet material of the outer shield panel 600*o* folded over so as to leave a gap sized to slidably receive the inner shield panel 600*i*.

Figure 8:
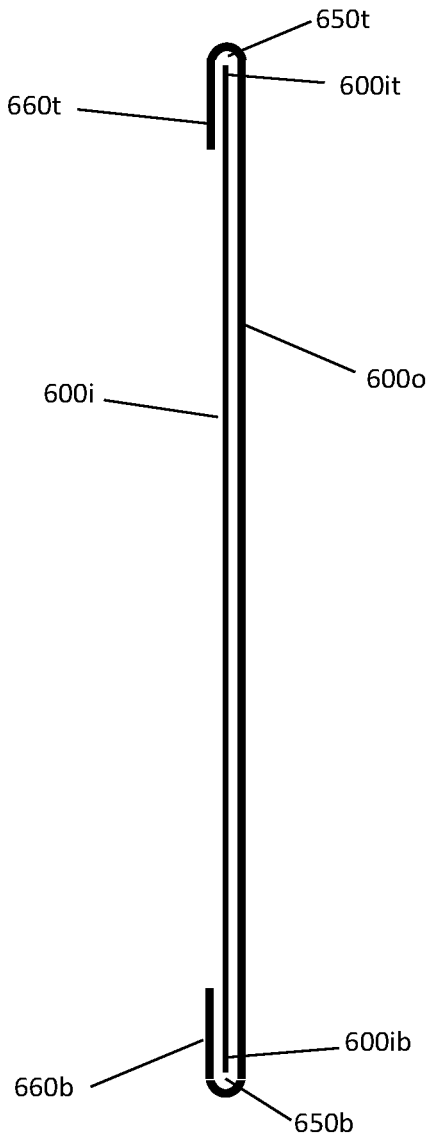
FIG. 8 is a cross sectional view of the embodiment of FIG. 7 taken along line 8-8.

The channels and the sliding relationship between the inner and outer shield panels are further illustrated in FIG. 8, which is a cross sectional view of the embodiment illustrated in FIG. 7 taken along line 8-8. Specifically, a top channel flap 660*t* is shown as a continuous extension of the same sheet material forming the outer shield panel 600*o*. The flap 660*t* is folded over parallel to the outer shield panel 600*o* defining a top channel 650*t* comprising a gap between the flap 660*t* and the outer shield panel 600*o* sized to receive the top edge 600*it* of the inner shield panel 600*i* in a suitable clearance fit. The skilled artisan will readily appreciate that the fit shown in FIG. 8 is exaggerated for the sake of illustration. The bottom channel 650*b* of the illustrated embodiment is a mirror image of the top channel 650*t*, and is similarly formed by folding flap 660*b* of the outer shield panel 600*o* over while leaving a suitable gap to receive the bottom edge 600*ib* of the inner shield panel 600*i* in a suitable clearance fit.

Figure 9:
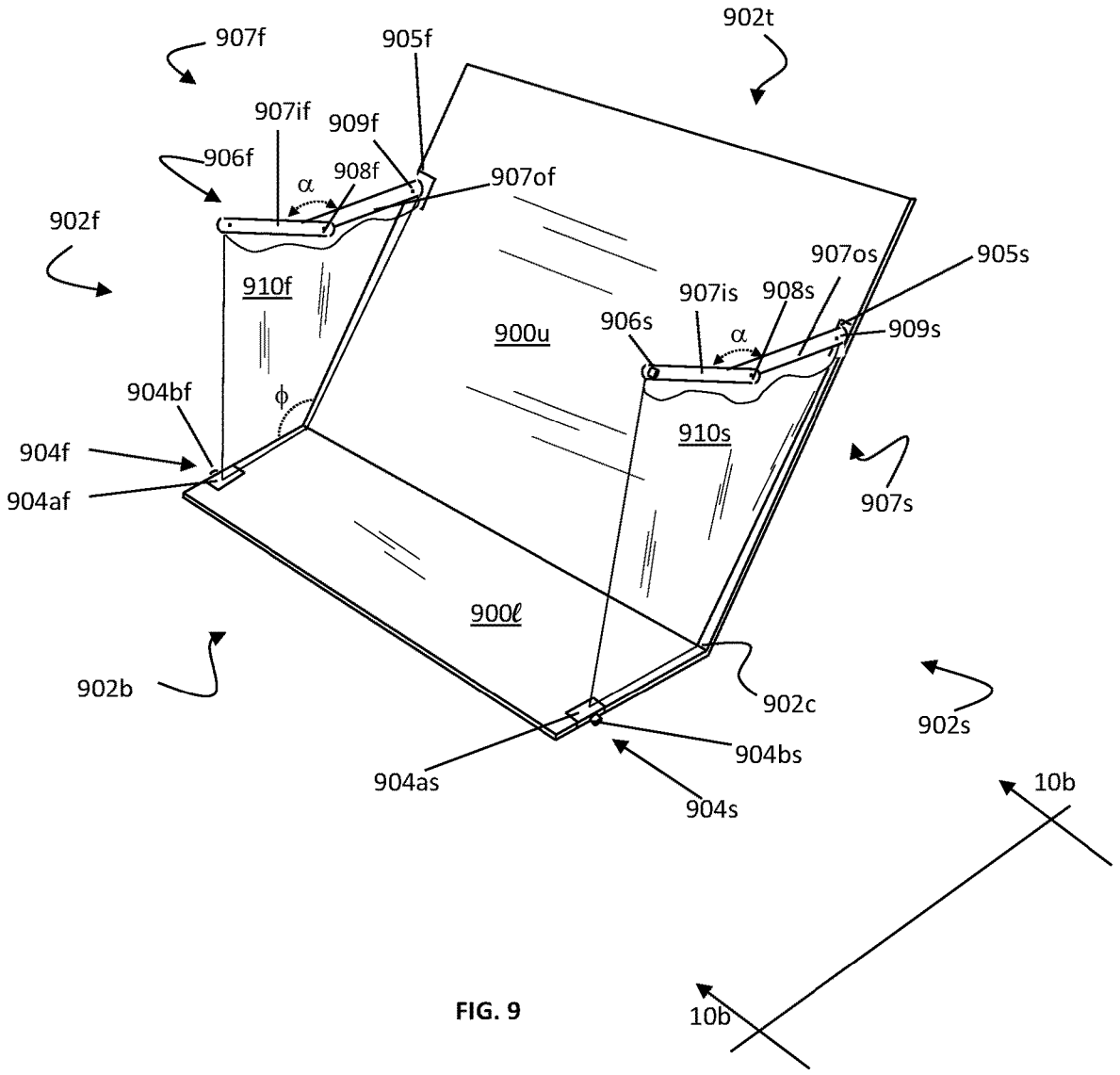
FIG. 9 is an elevation view of an embodiment.

Turning to FIG. 9, an embodiment is illustrated that is designed to be integrated with an architectural window as a built-in component thereof. This built-in embodiment includes an upper shield panel 900*u* and lower shield panel 900*l*. The upper and lower panels may be comprised of the same continuous sheet material bent along a shield panel crease 902*c* at a fixed angle $\phi$. Though referred to as a crease, the skilled artisan will readily appreciate that the shield panel crease 902*c* need not be a sharp crease, but rather may be a gentle rounded bend as well.

What is important is that the upper and lower panels subtend an angle $\phi$ sufficient provide an open space allowing for outside air to flow in through the window. Suitable values of $\phi$ include, without limitation, between 100 and 170 degrees. Other suitable ranges include between 100° and 110°, 110° and 120°, 120° and 130°, 130° and 140°, 140° and 150, 150° and 160°, 160° and 170°, and any combination thereof.

With continuing reference to FIG. 9, the embodiment includes a top edge 902*t*, a bottom edge 902*b*, a first side 902*f*, and a second side 902*s*. According to the illustrated embodiment lower fixed pivots 904*f*, 904*s* are created on the first and second sides 902*f*, 902*s* of the lower shield panel 900*l* by mounting a pivot pin. More specifically, a first pivot pin mounting bracket 904*af* is joined, according to well-known means, to the first side 902*f* of the lower shield panel 900*g*. The mounting bracket 904*af* includes a pivot pin 904*bf*. Similarly, a second mounting bracket 904*as* is joined to the second side 902*s* of the lower shield panel 900*l*, and similarly includes a pivot pin 904*bs*. The pivot points 904*f*, 904*s* are co-operably received by apertures defined in the inside frame of an architectural window (not shown). The skilled artisan will readily appreciate that the invention is not limited to the illustrated pivot pins, or even to mounted pivot pins. Any of a wide variety of means well-known in the art accomplish the same pivoting function and are thus within the scope of the invention. By way of non-limiting example, pivot pins may be integral and continuous with the lower shield panel 900*l*, as a single molded part. Alternatively, the male pins may be integral with the cooperating window frame while the lower shield member may instead include female recesses for receiving the pivot pins.

With continuing regard to FIG. 9, the illustrated embodiment includes a retractable upper lateral support in the form of a pair of folding braces 907*f*, 907*s*. 906 outer arm 907*of*, 907*os*. The inner and outer arms are pivotally joined at first and second bifold points respectively 908*f*, 908*s* thus defining an angle α between the inner and outer arms. The angle α varies between about zero degrees when the illustrated embodiment is fully stowed and about 180 degrees when it is fully deployed. In FIG. 9 the inner 907*if*, 907*is* and outer 907*of*, 907*os* arms are shown in an intermediate configuration where a is between 0° and 180°. The outer arms 907*of*, 907*os* of the illustrated embodiment are shown pivotally joined to first and second folding brace mounting brackets 905*f*, 905*s* at first and second pivot points 909*f*, 909*s*. The mounting brackets 905*f*, 905*s* may be joined to either side 902*f*, 902*s* of the upper shield panel 900*u* through any suitable means known in the art. Moreover, the pivot points 908*f*, 908*s*, 909*f*, and 909*s* may comprise any of a wide variety of well-known structures for achieving such motion, for example and without limitation, common structures include pins, rivets, or similar annular structures suitable for use as journals.

With further reference to FIG. 9, the folding braces 907*f*, 907*s* include slide pins 906*f* (not visible), 906*s* outward-laterally disposed on outward-facing surfaces of the first and second inner arms 907*if*, 907*is* of the first and second folding braces 907*f*, 907*s*. The first and second slide pins 906*f* (not visible), 906*s* are outward-laterally disposed so as to slidably cooperate with dedicated vertical tracks disposed on the inside of the window frame (not shown) lateral to the embodiment. The upper lateral supports thus support the rain shield in tension with the tracks of the window frame. The operation of the slide pins 906*f* (not visible), 906*s* and the embodiment overall is more readily apparent with reference FIGS. 10A, 10B and 10C. These figures show a side view of the built-in embodiment of FIG. 9 from the direction indicated by line 10*b*-10*b*.

Figure 10A:
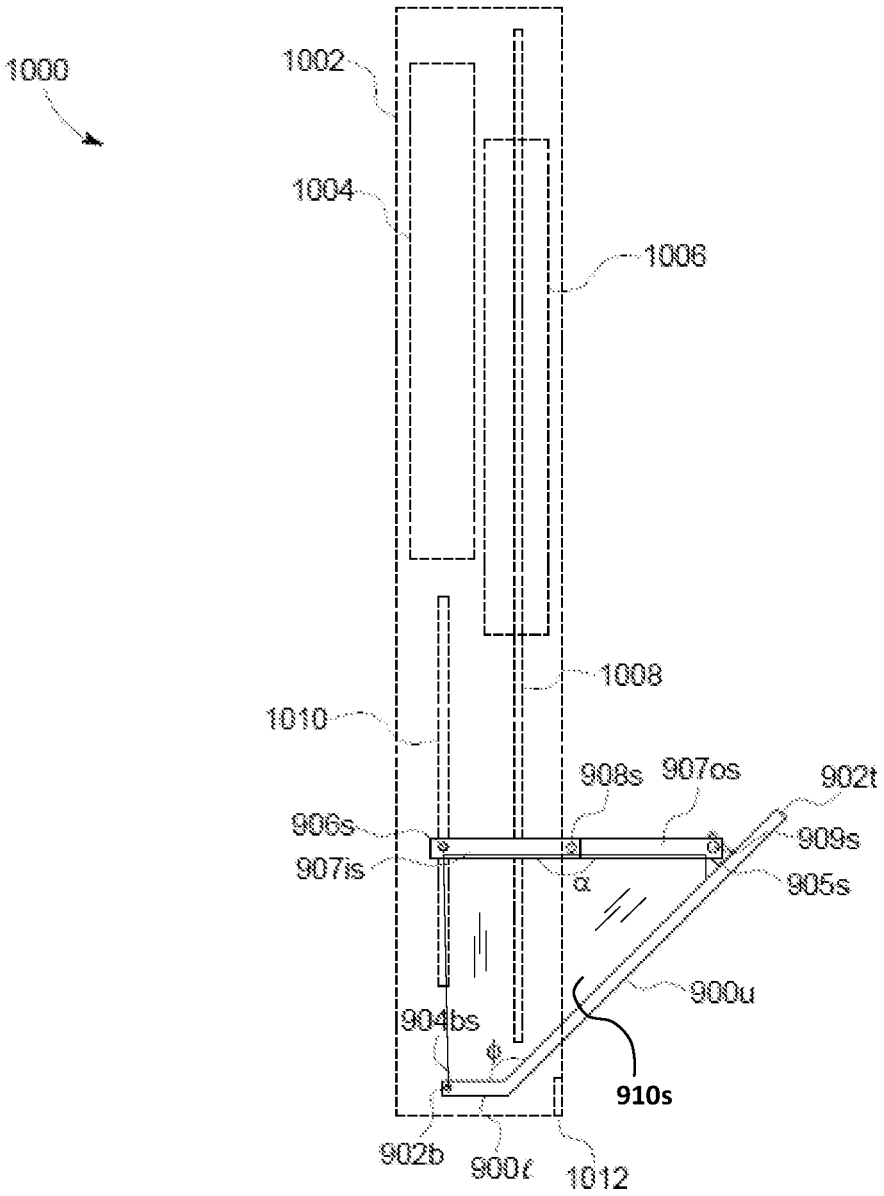
FIG. 10A is a side-view of the embodiment of FIG. 9 viewed from the direction indicated by line 10*b*-10*b* showing the embodiment in a fully deployed configuration.

Finally, with respect to FIG. 9, an embodiment may optionally include first and second folding side-panel baffles 910*f*, 910*s*, which serve to prevent rain from entering through the sides of the embodiment. FIG. 9 illustrates the baffles 910*f*, 910*s* in an intermediate state between stowed and deployed. Thus, the baffles 910*f*, 910*s* are shown partially folded. In contrast, FIG. 10A shows the second baffle 910*s* in a fully deployed state where the baffle is flat rather than partially folded. The person having ordinary skill in the art will readily understand that the baffles may take on any of a wide variety of forms. For example, and without limitation, a baffle may comprise a flexible polymer sheet fastened to a side of the device so that it folds with the device as the device is stowed and unfolds with the device as it is deployed. The ordinarily skilled artisan will readily understand how to fasten and/or bond the polymer sheet to the device according to well-known means.

Turning now to FIG. 10A, a single-hung window 1000 is shown with the built-in embodiment of FIG. 9 operably installed and in a fully deployed configuration. The window 1000 includes a window frame 1002 receiving a fixed upper window pane 1004 and a slidable lower window pane 1006. The slidable lower window pane 1006 is slidably received by a track 1008 such that window pane 1006 can be raised and lowered to open and close the window 1000. The inner and outer arms 907*is*, 907*os* are shown fully extended such that they subtend an angle α of about 180 degrees. The second slide pin 906*s* is shown slidably engaging integral track 1010, which is built into the window frame 1002. The lower shield panel 900*l* is shown roughly parallel to the bottom of the window frame 1002, although the relative orientation of the lower shield panel in this respect is a matter of convenience. The second pivot pin 904*bs* pivotably engages an aperture (not shown) in the window frame 1002. Accordingly, lower end of the embodiment is fixed in place except that it is free to rotate about the second pivot pin 904*bs*, The upper shield panel 900*u* may or may not rest against the bottom lip 1012 of the window when the embodiment is fully deployed. The second baffle 910*s* is also shown in a fully deployed configuration. This structure is not illustrated in FIGS. 10B and 10C, although FIGS. 10B and 10C otherwise illustrate the same structure as FIG. 10A.

Figure 10B:
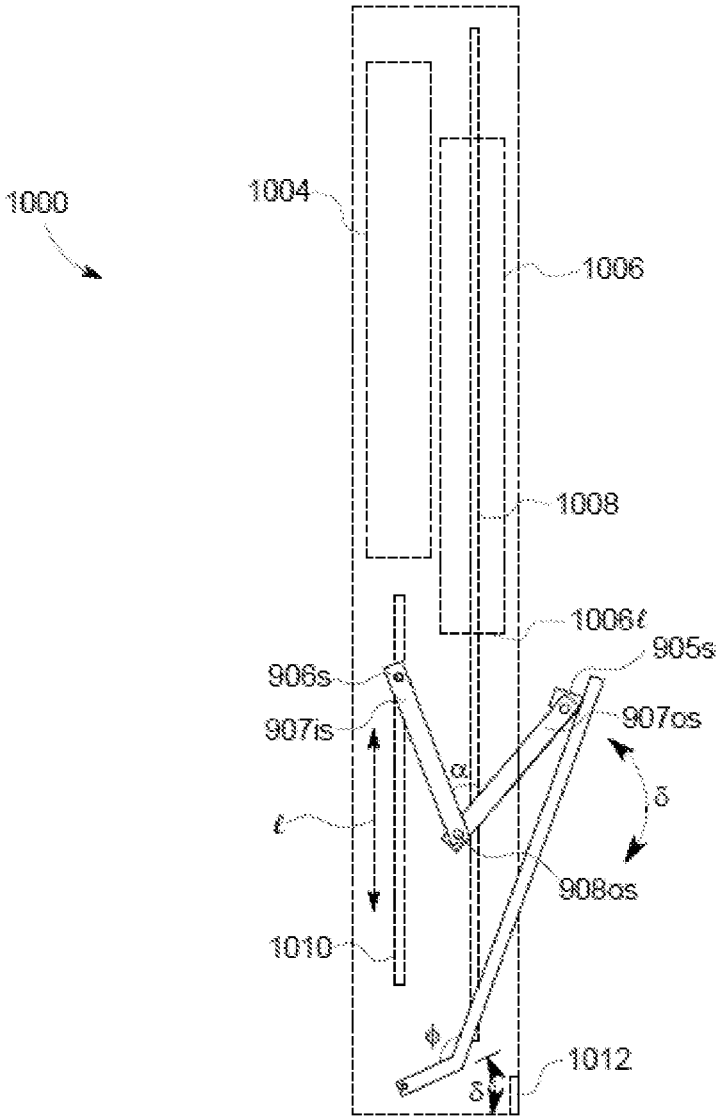
FIG. 10B is a side-view of the embodiment of FIG. 9 viewed from the direction indicated by line 10*b*-10*b* showing the embodiment in a configuration between deployed and stowed.
Figure 10C:
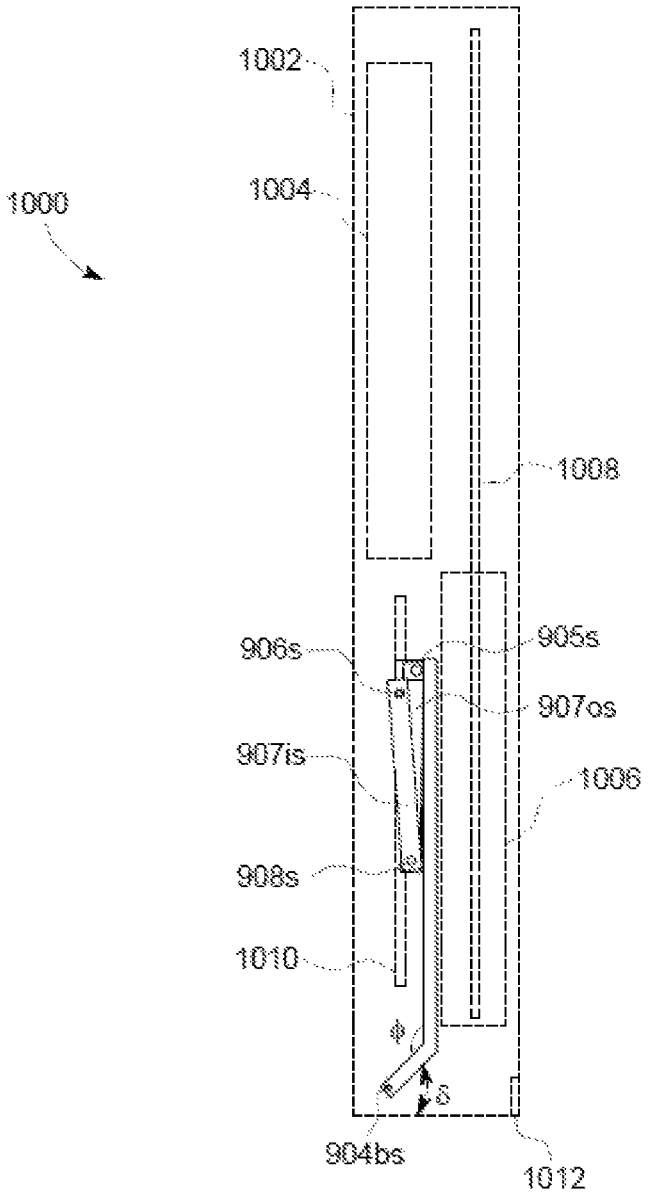
FIG. 10C is a side-view of the embodiment of FIG. 9 viewed from the direction indicated by line 10*b*-10*b* showing the embodiment in a fully stowed configuration.

Turning to FIG. 10B, the built-in embodiment is illustrated in an intermediate state between fully deployed and fully stowed. While the angle ϕ remains fixed, the angle α is somewhere between 0° and 180°. The second slide pin 906*s* has slid upward according to line l along track 1010. The top edge 902*t* of the upper shield panel 900*u* has swung an angle δ from its fully deployed position along a path that will allow it to clear the lower edge 1006*l* of the sliding lower window pane 1006. Finally, as shown in FIG. 10C, and a is zero and sliding pin 906*s* has reached the top of its range of motion in track 1010. Accordingly, the inner and outer folding brace arms 907*is*, 907*os* are fully folded, and the built-in embodiment is fully stowed. Thus, the lower sliding window pane 1006 can be closed.

While the folding braces 907*f*, 907*s* have been discussed in detail, the skilled artisan will appreciate that this is only one among a wide range of suitable structures. Any known structure or combination of structures that provide suitable bracing to protect the embodiment from vertical loading while deployed would be a suitable substitute. Advantageously, such structure may also provide for retaining the embodiment in a fully stowed and/or fully deployed position and/or even in intermediate positions such as that of FIG. 10B. For example, the illustrated bifold braces may include one or more simple ball catches to fix the position of a brace.

Such a ball catch is known to be readily made by metal stamping a hemispherical divot into matable parts; the male side of one mating with the female side of the other. Other such retaining structures are well known in the art, and may include, for instance and without limitation, tight-fitting journal bearings having sufficient friction to hold the journal in a particular angular position under the weight of the rain shield itself, i.e. and without added loading, while providing for angular motion of the journal under small applied forces, i.e. easy manual manipulation. The skilled artisan will readily appreciate that such journal bearings may be incorporated into either or both of the lower fixed pivots, either or both of the upper lateral supports, or any combination thereof. Other retaining structures may include window frame-mounted retaining clips adapted to cooperate with the upper or lower shield panel, or any other suitable part of the rain shield, in a snap fit to hold it in a stowed configuration. Again, the foregoing retaining structures are recited merely for the purpose of illustrating the myriad suitable solutions that the skilled artisan may select as a matter of design choice. Accordingly, the skilled artisan would readily appreciate how to adapt embodiments of the invention to retain them in a stowed and/or deployed configuration.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

The following list shows the correlation between the various reference numerals used in the appended drawings, and the elements of the drawings that they represent. This list is provided only for convenience and is not intended to be limiting in any way. Abbreviated, shortened, or otherwise somewhat different wording may be used herein to describe the same structures or drawing elements without obscuring their meaning to the person having ordinary skill in the art.

δ swing angle
α angle between inner and outer arms of the folding brace ($0° \leq \alpha \leq 180°$)
ϕ fixed inside angle between the upper and lower shield panels
l linear motion of slide pin (e.g. 906*s*)
400 shield panel
405*t* top edge of shield panel 400
405*b* bottom edge of shield panel 400
405*f* first side edge of shield panel 400
405*s* second side edge of shield panel 400
410 first side panel member
410*t* top edge of first side panel member
410*h* hinge side edge of first side panel member
410*c* clasp side edge of first side panel member
410*o* outward face of first side panel member
410*i* inward face of first side panel member
412 first flex hinge panel
420 second side panel member
420*t* top edge of second side panel member
420*h* hinge side edge of second side panel member
420*c* clasp side edge of second side panel member
420*o* outward face of second side panel member
420*i* inward face of second side panel member
422 second flex hinge panel
430 first clasp member
440 second clasp member
600 shield member
600*i* inner shield panel
600*it* top edge of inner shield panel
600*ib* bottom edge of inner shield panel
600*if* first side edge of inner shield panel
600*is* second side edge of inner shield panel
600*o* outer shield panel
600*ot* top edge of outer shield panel
600*ob* bottom edge of outer shield panel
600*of* first side edge of outer shield panel
600*os* second side edge of outer shield panel
610 first side panel
610*o* first outward face of first side panel
610*i* first inward face of first side panel
610*t* first top side edge of first side panel
610*h* first hinge side edge of first side panel
610*c* first clasp side edge of first side panel
612 first flex hinge panel
620 second side panel
620*o* second outward face of second side panel
620*i* second inward face of second side panel
620*t* second top side edge of second side panel
620*h* second hinge side edge of second side panel
620*c* second clasp side edge of second side panel
622 second flex hinge panel
630 first clasp member
640 second clasp member
650*t* top channel
650*b* bottom channel
660*t* top channel flap
660*b* bottom channel flap
900*u* upper shield panel
900*l* lower shield panel
902*t* top edge
902*b* bottom edge
902*f* first side
902*s* second side
902*c* shield panel crease
904*f* first lower fixed pivot
904*af* first pivot pin mounting bracket
904*bf* first pivot pin
904*s* second lower fixed pivot
904*as* second pivot pin mounting bracket
904*bs* second pivot pin
905*f* first folding brace mounting bracket
905*s* second folding brace mounting bracket
906*f* first slide pin (arrow pointing out-of-view)
906*s* second slide pin
907*f* first folding brace
907*if* inner arm of first folding brace
907*of* outer arm of first folding brace
907*s* second folding brace
907*is* inner arm of second folding brace
907*os* outer arm of second folding brace
908*f* first bifold point pivot structure
908*s* second bifold point pivot structure
909*f* first folding brace mounting bracket pivot structure
909*s* second folding brace mounting bracket pivot structure
910*f* first folding side-panel baffle
910*s* second folding side-panel baffle
1000 single hung window
1002 window frame
1004 fixed upper window pane
1006 sliding lower window pane
1006*l* lower edge of sliding lower window
1008 track for sliding lower window
1010 track for second slide pin (906*s*)
1012 window bottom lip

Having thus described the invention, it is now claimed:

I claim:

1. A rain shield for an exterior architectural window, comprising:

a shield member defining a generally rectangular-planar surface having a top edge, a bottom edge, a first side edge, and a second side edge;

a first lower fixed pivot disposed on a lower portion of the first side of the shield member;

a second lower fixed pivot disposed on a lower portion of the second side of the shield member, wherein the first and second fixed pivots are oppositely directed from each other and are co-operably receivable by apertures or pins defined in an inside frame of an architectural window;

a first retractable upper lateral support disposed on an upper portion of the first side of the shield member wherein the first retractable upper lateral support comprises a first folding brace having a first slide pin outward-laterally disposed on an outward-facing surface of the first folding brace; and a second retractable upper lateral support disposed on an upper portion of the second side of the shield member.

2. The rain shield of claim 1, wherein the second retractable upper lateral support comprises a second folding brace having a second slide pin outward-laterally disposed on an outward-facing surface of the second folding brace, wherein the first and second slide pins are co-operable with laterally disposed vertical tracks of a window frame to support the rain shield in tension with the vertical tracks.

3. The rain shield of claim 2, further comprising a window frame;

a first laterally disposed vertical track of the window frame co-operable with the first slide pin to support the rain shield in tension, the first slide pin being slidably received by the first vertical track;

a second laterally disposed vertical track of the window frame co-operable with the second slide pin to support the rain shield in tension, the second slide pin being slidably received by the second vertical track; and wherein the window frame is dimensioned to receive the shield member, the first and second lower fixed pivots, and the first and second upper lateral supports in a fully stowed configuration without interfering with the window frame or with an upper or lower window pane.

* * * * *